United States Patent [19]

Bater

[11] Patent Number: 4,662,413

[45] Date of Patent: May 5, 1987

[54] FEED MECHANISM FOR WOODWORKING MACHINERY

[75] Inventor: Reginald K. Bater, Cleveland, United Kingdom

[73] Assignee: Wadkin plc, Leicester, England

[21] Appl. No.: 925,519

[22] Filed: Oct. 28, 1986

Related U.S. Application Data

[63] Continuation of Ser. No. 764,093, Aug. 9, 1985, abandoned.

[30] Foreign Application Priority Data

Oct. 24, 1984 [GB] United Kingdom ..... 8426857

[51] Int. Cl.[4] ..... B27C 1/12

[52] U.S. Cl. ..... 144/247; 83/436; 83/446; 83/706; 144/249 B

[58] Field of Search ..... 144/242 R, 242 C, 245 R, 144/246 R, 246 B, 247, 249 B; 83/436, 446, 706; 404/138, 157, 172, 173

[56] References Cited

U.S. PATENT DOCUMENTS

| | | | |
|---|---|---|---|
| 126,381 | 5/1872 | Durxee | 144/247 |
| 401,397 | 4/1889 | Wetherall | 144/247 |

FOREIGN PATENT DOCUMENTS

| | | | |
|---|---|---|---|
| 910724 | 5/1954 | Fed. Rep. of Germany | 144/247 |
| 1072127 | 9/1954 | France | 144/247 |
| 78957 | 8/1951 | Norway | 144/249 B |

*Primary Examiner*—W. D. Bray
*Attorney, Agent, or Firm*—Kalish & Gilster

[57] ABSTRACT

A roller (10) drives a workpiece (not shown, but to the right) along a fence. An electric motor (16) rotates the roller (10) through chains (18, 19) and a double sprocket (20) freely rotatable on an upright shaft (22). The roller (10) is rotatable in relation to an arm (26). The arm (26) is pivotable in relation to the shaft (22). A coil spring (30) around the shaft (22) is fastened at a lower end to a stop (32) and at an upper end of a collar (34), and urges the roller (10) towards the fence. The force of the spring (30) makes the roller (10) engage a wide workpiece strongly, and so increases its tractive effect.

4 Claims, 3 Drawing Figures

FEED MECHANISM FOR WOODWORKING MACHINERY

CROSS-REFERENCE TO RELATED APPLICATION

This application is a continuation of Ser. No. 764,093, filed 8/9/85 and now abandoned.

DESCRIPTION

Technical Field

The invention relates to mechanism whereby timber is fed to machinery such as rip saws.

BACKGROUND ART

Rip saws are customarily provided with powered feed rollers to drive timber workpieces along a fence and past a band saw blade. The positions of the feed rollers and fence relative to the blade are each adjustable by means of a handwheel and screw. The feed rollers are biassed towards the fence by means of a spring or weights or hydraulically. This allows a certain amount of variation, perhaps 25 mm in the width of the workpiece fed. The problem is to allow a greater variation in the width of the workpiece without the need to reposition the feed mechanism. A workpiece may be put through a machine a number of times, and reduced in width at each pass. The invention reduces the frequency at which it is necessary to adjust the position of the feed mechanism.

THE INVENTION

The invention provides feed mechanism for woodworking machinery comprising a roller for driving a workpiece along a fence and through the machine, power means for rotating the roller in relation to an arm, an upright shaft about which the arm is pivotable, and a spring biassing the arm so that the roller is urged towards the fence. The spring is preferably coiled around the upright shaft, fastened at one end to an adjustable stop and at the other end to a collar locked to the shaft.

The power means preferably comprises a chain drive from a motor to the roller via a double sprocket freely rotatable on the upright shaft. This makes it possible to gear down the rotational speed of the drive and avoid the use of a chain tensioner. The force of the spring makes the feed roller engage a wide workpiece strongly, and so increases its tractive effect.

DRAWINGS

BEST MODE

Figure 1:
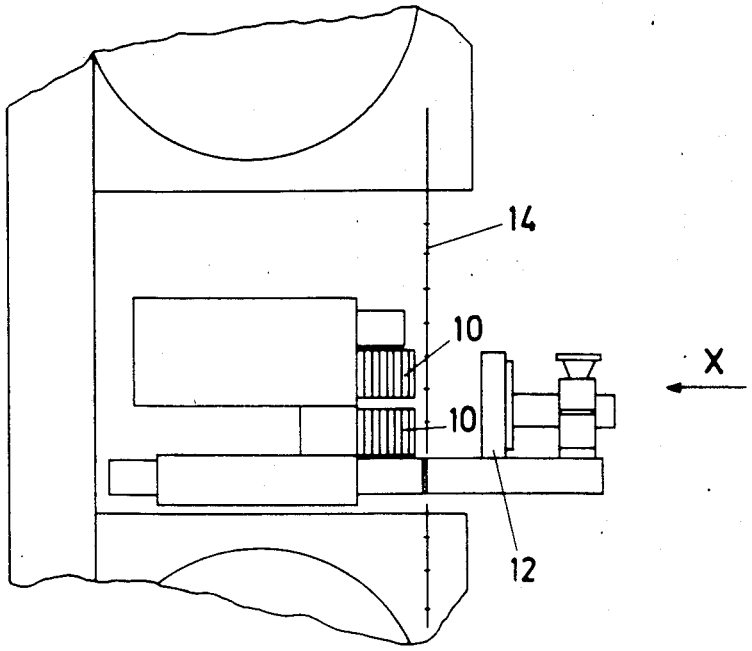
FIG. 1 is a view from the feed end of a power band rip saw incorporating a feed mechanism according to the invention.

With particular reference to FIG. 1, the saw comprises feed rollers 10 for driving a workpiece (not shown) along a fence 12 towards a blade 14.

Figure 3:
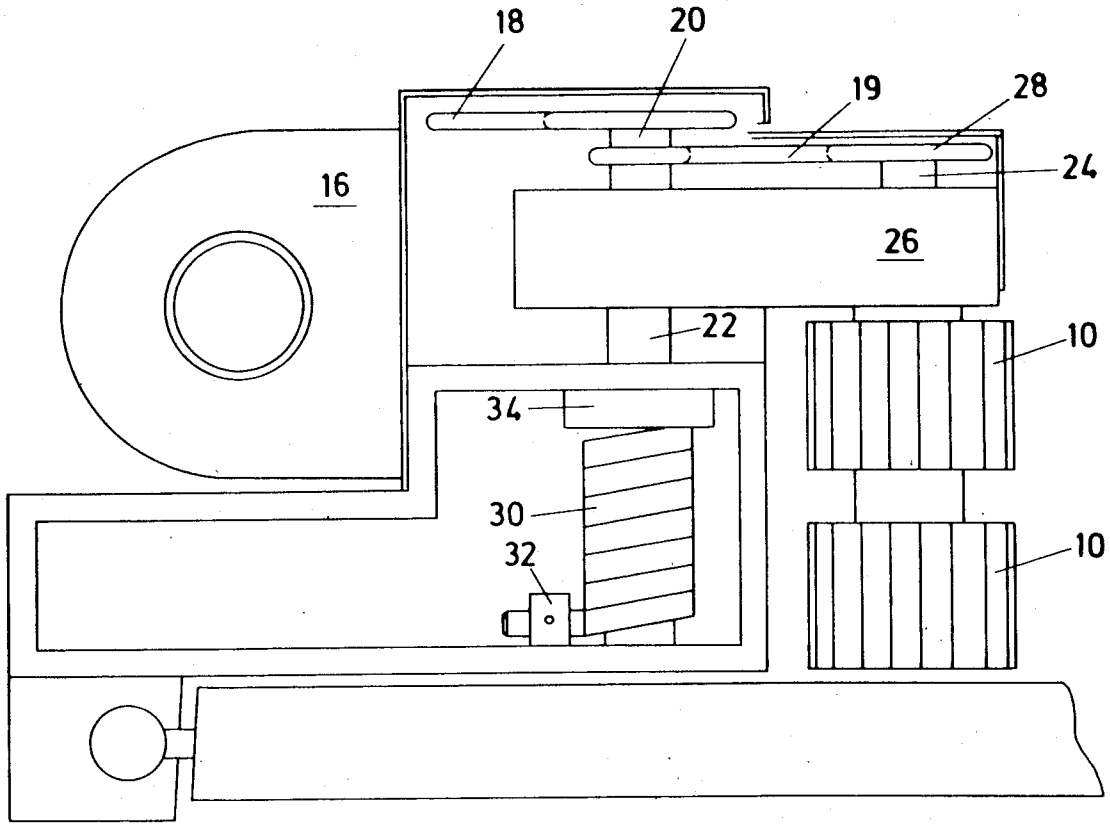
FIG. 3 is a schematic vertical sectional view of the feed mechanism in the direction of an arrow X in FIG. 1.

The section in FIG. 3 shows in greater detail how an electric motor 16 rotates the rollers 10 through chain 18, 19 via a double sprocket 20 freely rotatable at the top of an upright shaft 22. The rollers 10 are secured on a shaft 24 which is rotatably journalled in an arm 26 and driven through a chain sprocket 28.

Figure 2:
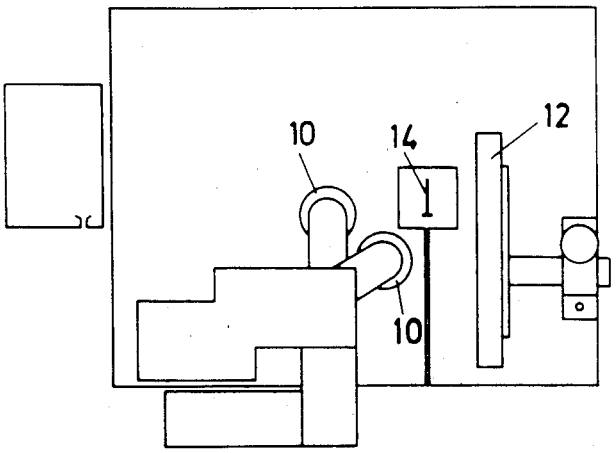
FIG. 2 is a plan view corresponding to FIG. 1.

The arm 26 is locked fast on the upright shaft 22, so the rollers 10 are rotated in relation to the arm 26. The arm 26 is pivotable through about 90°, said upright shaft 22 being rotatably mounted in bushes in a machine casing at its base and centre, and surrounded at its lower part by a coil spring 30. The coil spring 30 is fastened at a lower end to an adjustable stop 32 on the machine casing whereby the tension of the spring may be adjusted, and at its upper end to a collar 34 which is locked fast on the upright shaft 22. Thus the coil spring 30 biasses the shaft 22 and the arm 26 anti-clockwise as it would appear in FIG. 2 so that the rollers 10 are urged towards the fence 12 from a position B towards a position A.

INDUSTRIAL APPLICATION

Thus the rollers 10 drive the workpiece along the fence 12 and through the machine. The wider and/or heavier the workpiece the greater the force applied by the coil spring 30 to move the workpiece towards the fence 12, and consequently the greater the tractive effect of the rollers 10.

I claim:

1. A feed mechanism for woodworking machinery comprising a base, a fence or workpiece guide provided on said base, a first shaft disposed in upright position with relation to the base and having the longitudinal axis thereof perpendicular to the longitudinal axis of said fence, means journalling said first shaft to permit axial pivotal movement thereof, an arm having inner and outer ends and being fixedly secured in the inner end portion thereof on said first shaft and extending axially normal therefrom, a spring coiled around said first shaft downwardly of said arm and spacedly therefrom for biasing said shaft and arm in a predetermined direction, an adjustable stop provided on said base and engaging the lower end of said spring, a collar locked fixedly on said first shaft spacedly below said arm and engaging the upper end of said spring, a second shaft disposed between said first shaft and said fence and being supported by, and journalled in the outer end portion of said arm for rotation with respect thereto, a source of power, means connecting said source of power with said second shaft for effecting rotation thereof, and at least one workpiece feed roller carried on said second shaft downwardly of said arm and being rotatable with said second shaft whereby said second shaft is moveable with said arm and under bias of said spring said roller is urged toward said fence for driving a workpiece therealong.

2. The invention defined in claim 1 wherein the first shaft is journalled at the lower end thereof in said base and is journalled in the intermediate portion thereof, said arm being engaged on said first shaft above the intermediate journalled portion and downwardly of the upper end extremity of said shaft and said collar is located beneath said intermediate journalled portion.

3. The invention defined in claim 2 wherein the power connecting means comprises a double sprocket freely rotatable on said first shaft, a single sprocket fixed on said second shaft for rotation therewith, a first chain connecting said power source and said double sprocket, and a second chain interconnecting said double sprocket and said single sprocket.

4. The invention defined in claim 3 wherein there are first and second spaced apart workpiece feed rollers carried on said second shaft.

* * * * *